US009970395B2

(12) United States Patent
Huang

(10) Patent No.: US 9,970,395 B2
(45) Date of Patent: May 15, 2018

(54) ADMISSION PIPE STRUCTURE FOR AUTOMOBILE AIR ADMISSION

(71) Applicant: SPACE GEAR INDUSTRIAL LTD., Taipei (TW)

(72) Inventor: Jing-Yao Huang, Taipei (TW)

(73) Assignee: SPACE GEAR INDUSTRIAL LTD., Taipei (TW)

( * ) Notice: Subject to any disclaimer, the term of this patent is extended or adjusted under 35 U.S.C. 154(b) by 24 days.

(21) Appl. No.: 15/163,034

(22) Filed: May 24, 2016

(65) Prior Publication Data

US 2017/0082072 A1 Mar. 23, 2017

(30) Foreign Application Priority Data

Sep. 17, 2015 (TW) ..... 104215061 U

(51) Int. Cl.
*F02M 35/10* (2006.01)
*F02M 35/104* (2006.01)

(52) U.S. Cl.
CPC .... *F02M 35/10078* (2013.01); *F02M 35/104* (2013.01); *F02M 35/10111* (2013.01); *F02M 35/10144* (2013.01); *F02M 35/10222* (2013.01); *F02M 35/10268* (2013.01); *F02M 35/10327* (2013.01); *F02M 35/10006* (2013.01); *F02M 35/10091* (2013.01); *F02M 35/10209* (2013.01)

(58) Field of Classification Search
CPC ..... F02M 35/10006; F02M 35/10091; F02M 35/10144; F02M 35/10209
USPC ..... 123/184.61
See application file for complete search history.

(56) References Cited

U.S. PATENT DOCUMENTS 5,011,193 A * 4/1991 Porte ..... F16L 27/12 285/123.1
2004/0094111 A1* 5/2004 Concialdi ..... F02B 27/00 123/184.21
2012/0234001 A1* 9/2012 Neumann ..... F02M 26/05 60/599
2012/0292127 A1* 11/2012 Teshima ..... F02M 35/10144 181/224
2013/0180507 A1* 7/2013 Nakasugi ..... F02B 29/0437 123/542

* cited by examiner

*Primary Examiner* — Jacob Amick
*Assistant Examiner* — Charles Brauch
(74) *Attorney, Agent, or Firm* — Muncy, Geissler, Olds & Lowe, P.C.

(57) ABSTRACT

The present invention provides an admission pipe structure for automobile air admission, wherein internal part in pipe body of admission pipe includes channel, admission hole and exit hole formed on two sides of the channel are installed with first sleeve connection part and second sleeve connection part, and first sleeve connection part and second sleeve connection part are respectively sleeved onto exit connector and admission connector of the admission manifold pipe such that buckling component can be set up in penetration into two through-grooves installed in outer surface of second sleeve connection part thereby using buckling component to block at ring-shaped groove for fixedly positioning. When compressed air coming from the central cooler enters into admission pipe, compressed air can be smoothly guided by arc-shaped channel in pipe body, and aluminum alloy materials in admission pipe itself can prevent damages caused by the high-speed airflow of the compressed air.

4 Claims, 8 Drawing Sheets

ADMISSION PIPE STRUCTURE FOR AUTOMOBILE AIR ADMISSION

This application claims the priority benefit of Taiwan patent application number 104215061, filed on Sep. 17, 2015.

FIELD OF THE INVENTION

The present invention provides an admission pipe structure for automobile air admission; in particular, it is characterized in that the admission pipe can guide smoothly the compressed air and use the aluminum alloy materials in itself to prevent damages to the structure caused by the high-speed airflow of the compressed air, and also the temperature of the compressed air may be reduced upon passing through so as to lessen compression losses and relatively increase the oxygen contents such that the combustion efficiency of the compressed air entering into the engine may be improved.

BACKGROUND OF THE INVENTION

It is known that, due to rapid developments of industrial, commercial and economic activities in modern world as well as comprehensive elevations in national production incomes and consumption capabilities, further because of the prosperous, busy and efficiency-oriented urban lives, people residing in big cities generally utilize automobiles, motorbikes or the like as their traffic tools for transportation. However, just because the number of cars continues to grow, carbon dioxide or other exhaust gases released from the operations of engines have now become one of the major air pollution sources globally and caused serious issues related to the integral environment warming phenomena on the earth. Therefore, manufacturers in automobile industries have devoted large amounts of efforts on researches for enhancements in engine combustion performance and also provided various new types of automobiles capable of lessening carbon contents in the released exhaust air thereof in order to reduce environmental pollutions.

Moreover, because of great advancements in automobile engine technologies on current markets, the designs of automobile engines have stepped into an era of computer controls, which apply the electronic control unit (ECU) to manipulate the regulation throttle in the intake manifold pipe of an engine such that the automobile is able to determine or accelerate in accordance with the treading condition on the gas pedal thus adjusting the intake quantity so as to acquire an ideal air-combustion ratio in the engine and also meet the legal exhaust standard designated by the Environment Protection Agency. Meanwhile, it is appreciated that, to increase the output power of the engine without changing its working efficiency, it is only possible to raise the fuel quantity to enter into the cylinder by compressing more air thereby improving the combustion efficiency. Consequently, it is typical to additionally install a turbo charging system in the automobile to increase the air admission quantity, in which the turbo charging system uses the exhaust air released during the exhaust release stroke of the engine to drive the exit rotator in the turbo to rotate, and as soon as the exit rotator reaches a certain rotation speed, it will co-axially bring the admission rotator to forcibly suck in extra air. But, in this way, more air needs to be compressed, which may lead to rapidly elevated temperature thus causing less oxygen contents in the compressed air and reduced combustion efficiency. Hence, it is necessary to employ a central cooler to reduce the air temperature such that the intake air temperature may drop down after passing through the central cooler, so the lowered admission temperature may result in relatively higher oxygen contents therein.

In most cases, however, an admission pipe may be installed between the central cooler and the regulation throttle located at the admission manifold pipe or the front end in the admission manifold pipe of the engine for further connections, and the compressed air outputted from the central cooler passes through the admission pipe and the admission manifold pipe and then enters into the cylinder for combustion, while the regulation throttle cooperatively controls the flow speed of the compressed air entering into the cylinder, thus correspondingly increasing the fuel amount and elevating the combustion efficiency in the cylinder of the engine. But it should be noticed that, since the admission pipe is usually made of plastic materials (e.g., Acrylonitrile butadiene styrene copolymers, also known as ABS), and the compressed air passing through the admission pipe may be of sufficiently high temperature, the plastic materials in the admission pipe itself may expand because of heat thus becoming fragile and leading to lowered durability. Furthermore, the compressed air may pass through at a very high speed and the airflow around the turning corner of the admission pipe may be relatively intense, thus potentially causing damages to its structure because of insufficient tolerance for air pressure in the admission pipe. Accordingly, such aforementioned issues now become the key points to be researched and resolved by those skilled ones in relevant fields.

SUMMARY OF THE INVENTION

As such, in view of the above-said issues and drawbacks in prior art, the inventor of the present invention has collected relevant information, worked on various evaluations and considerations of many aspects, along with long-term research and development experiences from numerous practices and modifications in the related realms, thus creating the innovative admission pipe structure for automobile air admission in accordance with the present invention.

The primary objective of the present invention is characterized in that, the internal part in a pipe body of an admission pipe includes a channel, an admission hole and an exit hole on two sides of the channel are respectively installed with a first sleeve connection part and a second sleeve connection part, and the first sleeve connection part and second sleeve connection part are respectively sleeved onto a exit connector of a central cooler and an admission connector of an admission manifold pipe such that a buckling component can be set up in penetration into two through-grooves installed in cut on the outer surface of the second sleeve connection part thereby using the buckling component to block at a ring-shaped groove of the admission connector for fixedly positioning. When the compressed air coming from the central cooler enters into the admission pipe, the compressed air can be smoothly guided by the arc-shaped channel in the pipe body, and the good structural strength demonstrated by the aluminum alloy materials in the admission pipe itself can be utilized to prevent damages to the structure caused by the high-speed airflow of the compressed air. In addition, the aluminum alloy materials have higher coefficients of heat conductions such that the temperature can be reduced as the compressed air passes through thereby reducing pressure losses and increasing the oxygen contents, so that the compressed air may be released more rapidly and enter into the engine by way of the admission manifold pipe thus enabling better combustion efficiency.

The secondary objective of the present invention is characterized in that, upon assembling the second sleeve connection part of the admission pipe to the admission connector of the admission manifold pipe, it is possible to allow the buckling parts on two sides of a base part on the buckling component to respectively penetrate into the corresponding through-grooves of the second sleeve connection part and abut against the ring-shaped groove of the admission connector. Moreover, under the effect of the reverse push force from the ring-shaped groove, the buckling part may create an outward elastic transformation by using a elastic part as a supportive point, and the two elastic parts may, with the elastic transformation and restoration, relatively and inwardly clamp onto stopping faces of the two through-grooves by means of the clamping arm. Then, a stopping ring may be latched into the ring-shaped groove of the admission connector and the buckling part may abut against the ring-shaped groove therein such that the buckling component can be axially blocked to the face on the inner wall of the ring-shaped groove for fixedly positioning, thus the second sleeve connection part of the admission pipe may not easily fall out from the admission connector of the admission manifold pipe thereby enabling stable restricting and positioning functions as well as a retreat-blocking feature. This type of buckling component can facilitate more convenient assemblage for users and ensure stability in its integral structure.

Yet another objective of the present invention is characterized in that, an accommodation groove is configured in recess on the second sleeve connection of the admission pipe on the periphery of the exit hole toward the direction of the channel, and an O-shaped ring is positioned in the accommodation groove. Therefore, in assembling the second sleeve connection part of the admission pipe, the second sleeve connection part may be sleeved onto the admission connector of the admission manifold pipe and the O-shaped ring may abut against the accommodation groove due to the squeeze effect from the admission connector thus demonstrating an elastic transformation, so that slight or fine fissures possibly found between the second sleeve connection part and the admission connector can be completely sealed thereby creating a sealed state between the second sleeve connection part and the admission connector to effectively achieve the leakage blocking effect.

DETAILED DESCRIPTION OF THE ILLUSTRATED EMBODIMENTS

To achieve the aforementioned objective and effects, with regards to the technical means and structures utilized in the present invention, the structures and functions thereof will be hereunder set forth by the details descriptions concerning the preferred embodiments of the present invention along with appended drawings in order to facilitate comprehensive appreciation of the present invention.

Figure 1:
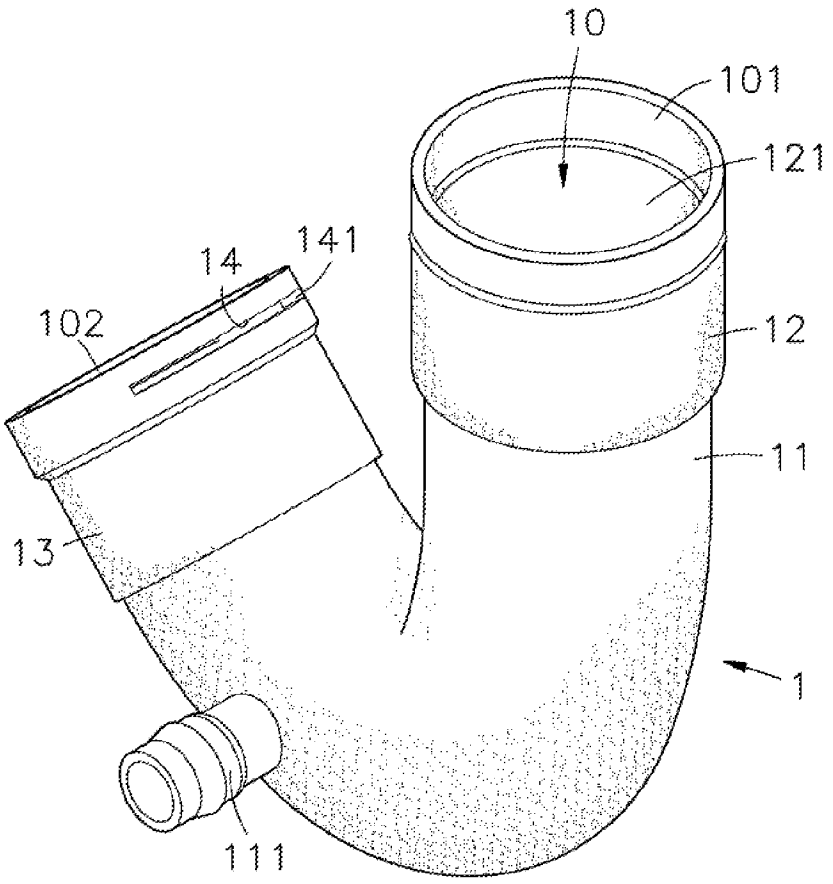
FIG. 1 shows a stereo perspective view of the present invention.
Figure 2:
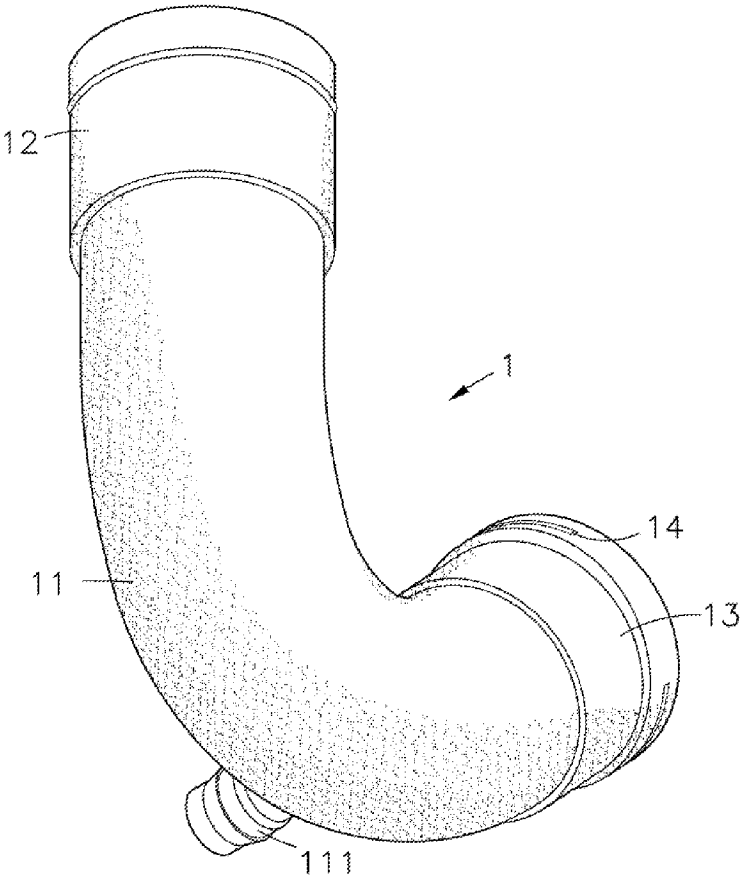
FIG. 2 shows a stereo perspective view of the present invention from another angle of view.
Figure 3:
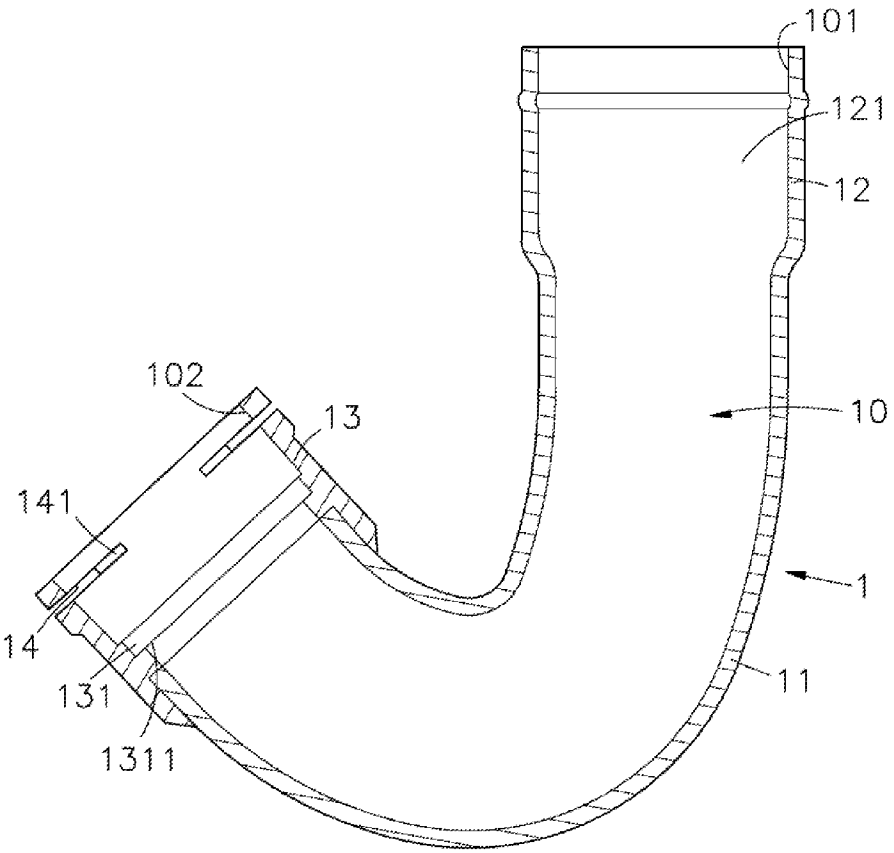
FIG. 3 shows a lateral cross-section view of the present invention.
Figure 4:
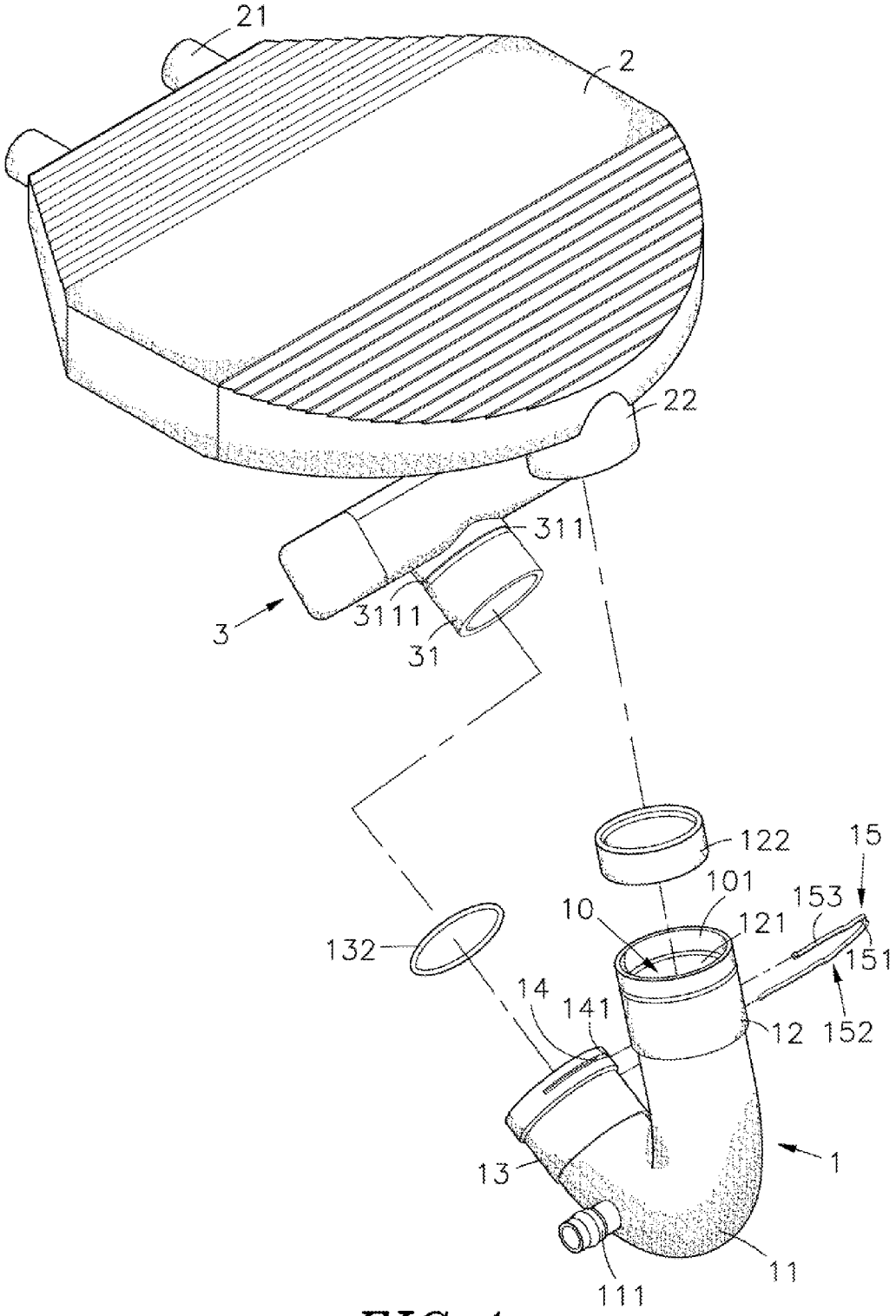
FIG. 4 shows a stereo disassembly view for a preferred embodiment of the present invention before assemblage.
Figure 5:
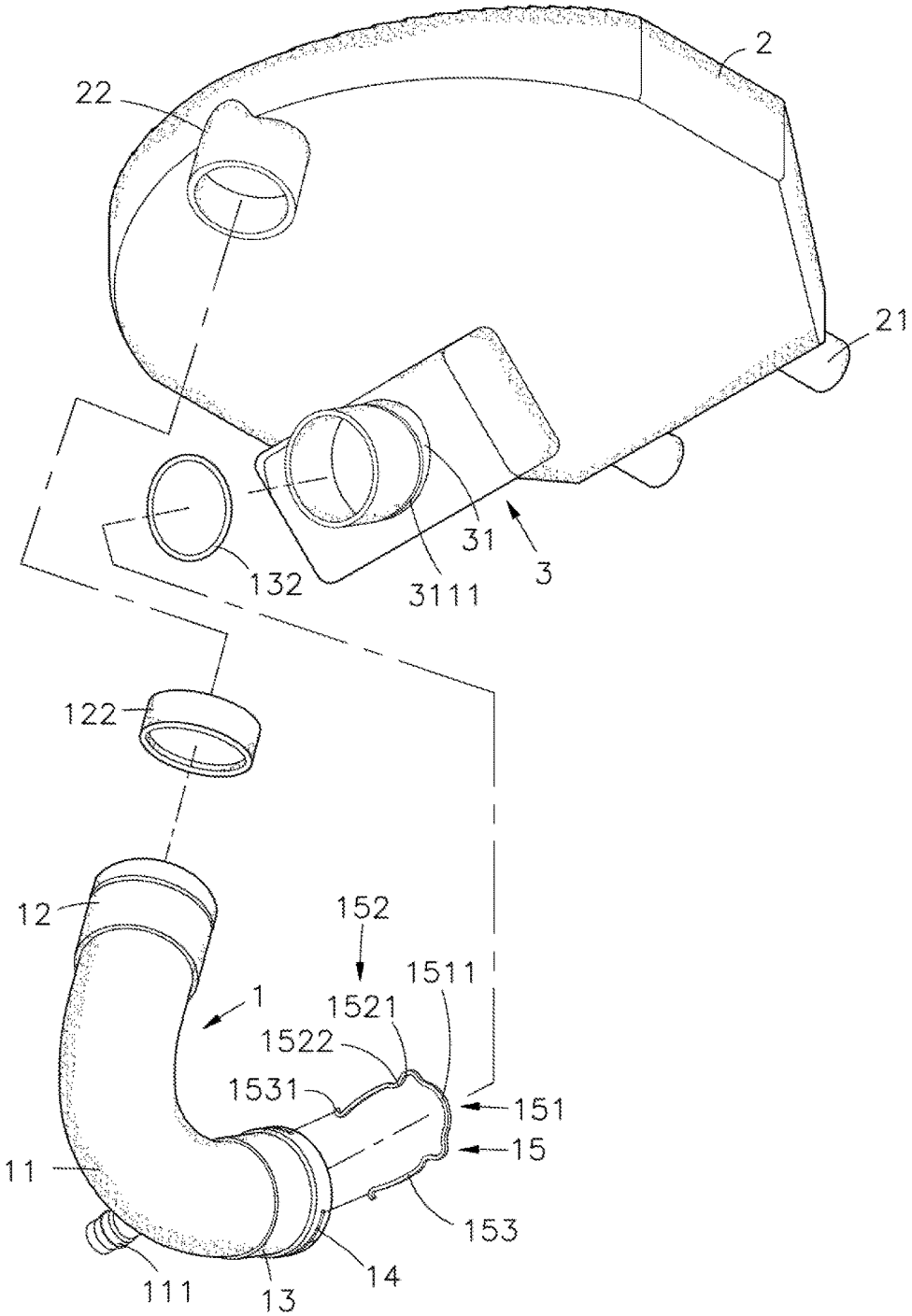
FIG. 5 shows a stereo disassembly view for a preferred embodiment of the present invention before assemblage from another angle of view.
Figure 6:
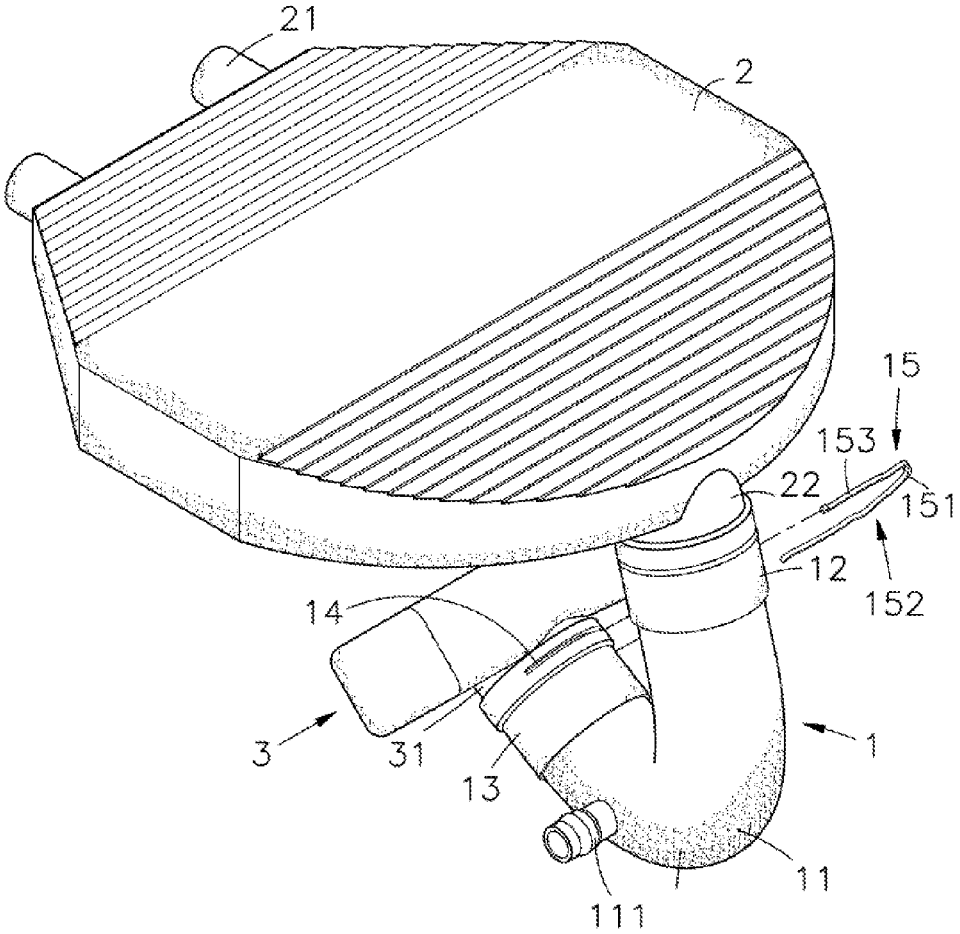
FIG. 6 shows a stereo perspective view for the preferred embodiment of the present invention in assemblage.
Figure 7:
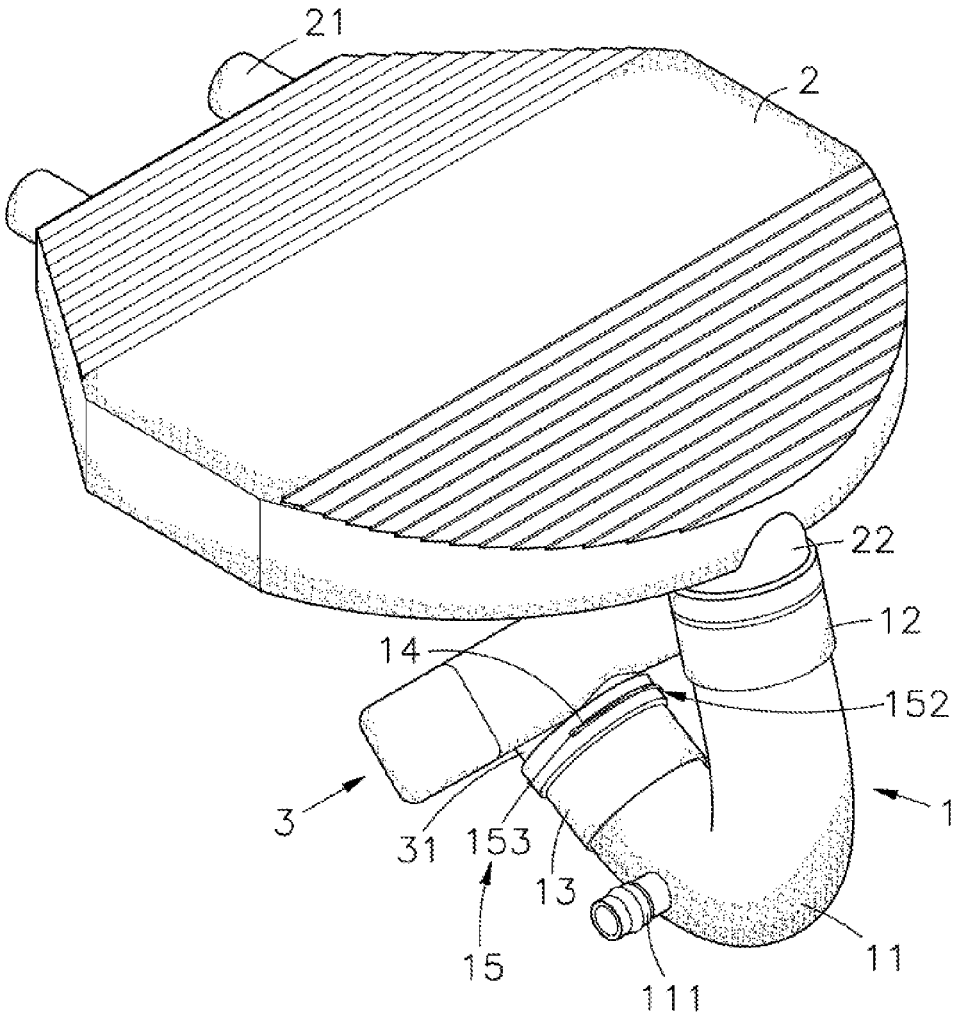
FIG. 7 shows a stereo perspective view for the preferred embodiment of the present invention after assemblage.
Figure 8:
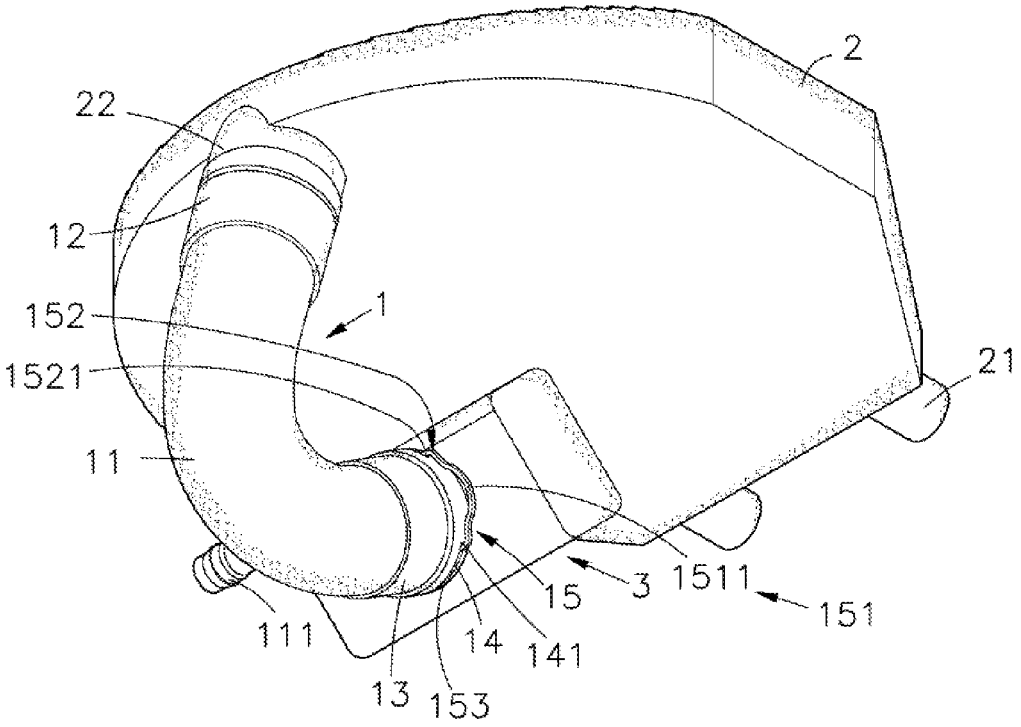
FIG. 8 shows a stereo perspective view for the preferred embodiment of the present invention after assemblage from another angle of view.

Refer to FIGS. 1, 2, 3, 4, 5, 6, 7 and 8, wherein a stereo perspective view, a stereo perspective view from another angle of view, a lateral cross-section view, a stereo disassembly view for a preferred embodiment before assemblage, a stereo disassembly view before assemblage from another angle of view, a stereo perspective view in assemblage, a stereo perspective view after assemblage and a stereo perspective view after assemblage from another angle of view according to the present invention are respectively shown. From the Figures, it can be clearly seen that the admission pipe structure for automobile air admission according to the present invention comprises an admission pipe 1 which includes an arc-shaped pipe body 11 turning first downwardly then upwardly, and a hollow channel 10 is formed inside the pipe body 11, an admission hole 101 and an exit hole 102 are formed on two sides of the channel 10, then an exhaust recycle connector 111 connected to the inside of the channel 10 is installed on the outer surface of the pipe body 11 near the central section, a first sleeve connection part 12 and a second sleeve connection part 13 are respectively installed at the admission hole 101 and the exit hole 102 of the admission pipe 1, and a position-limiting ring groove 121 having an enlarged diameter of hole for positioning a leakage blocking ring 122 is installed in recess on the first sleeve connection part 12 from the periphery of the admission hole 101 toward the direction of the channel 10. Meanwhile, an accommodation groove 131 having an enlarged diameter of hole for positioning an O-shaped ring 132 is installed in recess on the second sleeve connection part 13 from the periphery of the exit hole 102 also toward the direction of the channel 10, and then an abutting face 1311 is formed on the bottom of the accommodation groove 131 adjacent to the channel 10.

Moreover, at least two through-grooves 14 connected to the inside of the channel 10 are installed in cut on the outer surface of the second sleeve connection part 13 of the admission pipe 1, and the inner wall surfaces of the two neighboring through-grooves 14 both include a tilted stopping face 141. Also, a buckling component 15 is installed in penetration within the two through-grooves 14 of the admission pipe 1, an arch-shaped pull ring 1511 is formed at the center of a base part 151 included in the buckling component 15 thereof, and two sides of the base part 151 extend outwardly to form a relative elastic part 152 and an arc-shaped buckling part 153. In addition, the two elastic parts 152 bend inwardly adjacent to the base part 151 to form clamping arms 1521, and then respectively turn outwardly to extend and form a stopping ring 1522, while the ends of the two buckling parts 153 form abutting ends 1531 turning outwardly.

The admission pipe 1 according to the present invention may be installed between a central cooler 2 of the turbo charging system in an automobile (e.g., a car) and the regulation throttle (not shown) at an admission manifold pipe 3 or the front end of the admission manifold pipe 3 of an engine, and may be connected to the air outlet of the turbo by way of an admission connector 21 of the central cooler 2. When the exhaust air of high temperature and high speed released during the operation of the engine flows into the turbo at the exhaust side, the inertial thrust of the exhaust may push the turbo in the turbo chamber to rotate and the turbo may co-axially drive the fan wheel to rotate simultaneously so as to forcibly compress the entering air by means of the fan wheel. Also, the compressed air having dramatically increased temperature passes through the internal heat-sinks of the central cooler 2 to cool down thus becoming the compressed air having a certain pressure and high density, and the lower oxygen contents in the compressed air may accordingly elevate, then flowing through an exit connector 22 of the central cooler 2, the admission pipe 1, the regulation throttle and the admission manifold pipe 3 to enter into the engine cylinder for combustion. As the engine rotation speeding up, the exhaust release speed and the turbo rotation speed may also accelerate at the same time, so the fan wheel may compress more air thus controlling the flow speed of the compressed air entering into the engine cylinder via the admission manifold pipe 3 cooperatively by means of the regulation throttle. Besides, since the increased pressure and density of the compressed air may burn more fuel, it is possible to correspondingly augment more fuel amount and improve the combustion efficiency inside the engine cylinder thereby achieving the objective of enhanced engine output power.

To assemble the present invention, the leakage blocking sleeve ring 122 of the admission pipe 1 is first latched into the position-limiting ring groove 121 of the first sleeve connection part 12, and the first sleeve connection part 12 is placed in alignment to the exit connector 22 of the central cooler 2 by means of the admission hole 101 of the pipe body 11. Next, the first sleeve connection part 12 is sleeved onto the exit connector 22 thus allowing the exit connector 22 to penetrate and abut closely to an inner wall face of the leakage blocking sleeve ring 122 for fixedly positioning such that a sealed state can be created between the exit connector 22 and the first sleeve connection part 12 of the admission pipe 1. Following this, the O-shaped ring 132 is latched into the accommodation groove 131 of the second sleeve connection part 13, and the second sleeve connection part 13 is placed in alignment to an admission connector 31 of the admission manifold pipe 3 by means of the exit hole 102 of the pipe body 11 thereby sleeve connecting the second sleeve connection part 13 onto the admission connector 31 and placing in alignment the two through-grooves 14 of the second sleeve connection part 13 to a ring-shaped groove 311 on the outer surface of the admission connector 31. Moreover, due to the squeeze effect from the admission connector 31, the O-shaped ring 132 can abut against the abutting face 1311 of the accommodation groove 131 to exhibit an elastic transformation, thus creating a sealed state between the second sleeve connection part 13 and the admission connector 31.

Subsequently, the two buckling parts 153 of the buckling component 15 can respectively penetrate into the corresponding through-groove 14 on the second sleeve connection part 13, and the abutting end 1531 of the buckling part 153 can go through the through-groove 14 and abut against the ring-shaped groove 311 of the admission connector 31. Moreover, under the effect of the reverse push force from the ring-shaped groove 311, the buckling part 153 may create an outward elastic transformation by using the elastic part 152 as a supportive point, and the two elastic parts 152 may, through the elastic transformation and restoration, relatively and inwardly clamp onto the stopping faces 141 of the two through-holes 14 by means of the clamping arm 1521. Furthermore, the stopping ring 1522 may be latched into the ring-shaped groove 311 of the admission connector 31 and the abutting end 1531 of the buckling part 153 may abut against the inside of the ring-shaped groove 311 such that the buckling component 15 can be axially blocked to an abutting face 3111 on the inner wall of the ring-shaped groove 311 for fixedly positioning, thus the second sleeve connection part 13 of the admission pipe 1 may not easily fall out from the admission connector 31 of the admission manifold pipe 3 thereby enabling stable restricting and positioning functions as well as a retreat-blocking feature. This type of buckling component 15 can facilitate more convenient assemblage of the admission pipe 1 and the admission manifold pipe 3 for users and ensure stability in the integral structure.

When the compressed air outputted by the central cooler 2 goes into the admission hole 101 located on one side of the admission pipe 1 by way of the exit connector 22, it can be well guided by the arc-shaped channel 10 in the pipe body 11 such that the compressed air can flow smoothly without undesirable blockage or stocking issues, and, after rapidly leaving via the exit hole 102 on the other side of the admission pipe 1, it flows through the regulation throttle and the admission manifold pipe 3 and enters into the engine cylinder for combustion so as to accelerate the flow speed of the compressed air entering into the engine cylinder thereby correspondingly increasing the amount of fuel and enhancing the combustion efficiency and output power in the engine cylinder. Also, under the squeeze effect, the O-shaped ring 132 may demonstrate an elastic transformation such that the O-shaped ring 132 can completely seal minor or tiny fissures possibly existing between the second sleeve connection part 13 and the admission connector 31 in order to generate the leakage blocking feature. This type of admission pipe 1 may be made of aluminum alloy materials and the arc-shaped structural design of the pipe body 11 can well guide the compressed air so as to prevent undesirable conditions, e.g., airflow turbulences or strays of the compressed air within the channel 10, such that the compressed air may travel stably and smoothly and noises caused by airflow turbulences may be reduced as well. Moreover, the aluminum alloy materials contained in the admission pipe 1 itself can provide good structural strength thereby preventing damages to the structure as the compressed air flowing through at high speed as well as durability. Besides, the properties of higher coefficients of heat conductions and fast heat dissipation offered by the aluminum alloy materials in the admission pipe 1 can also lower the temperature of the compressed air when passing through the channel 10 so as to reduce the pressure losses. In addition, the lowered admission temperature of the compressed air may also relatively increase the oxygen contents therein so as to enable better combustion efficiency as the compressed air being fast released and entering into the engine via the regulation throttle and the admission manifold pipe 3, thus allowing to correspondingly add greater amount of fuel such that the output power of the engine can be significantly improved.

The aforementioned detailed descriptions have been set forth merely with regards to the preferred embodiment of the present invention, but the illustrated embodiment is by no means intended to restrict the scope of the present invention. Accordingly, all other effectively equivalent changes, modifications and alternations made without departing from the scope and spirit of the present invention should be considered as falling within the coverage defined hereunder by the claims of the present invention.

In summary, the aforementioned admission pipe structure for automobile air admission according to the present invention is capable of achieving the intended effects and objectives thus demonstrating the values thereof with regards to usefulness and innovation and fulfilling the requirements on patent applications, so the present application is herein submitted based on relevant regulations in order to legally protect the inventor's efforts for the present invention. Should there be any questions or instructions from the examiners of your Office, the inventor of the present invention will be very pleased to cooperate and provide any further information concerning the present application in details.

What is claimed is:

1. An admission pipe structure for automobile air admission comprises an admission pipe installed between an exit connector of a central cooler and an admission connector of an engine admission manifold pipe, wherein the hollow internal part in an arcshaped pipe body of the admission pipe includes a channel, an admission hole and an exit hole formed on two sides of the channel are respectively installed with the exit connector which is sleeved onto the central cooler as well as a first sleeve connection part and a second sleeve connection part on the admission connector of the admission manifold pipe, at least two through-grooves connected to the inside of the channel are installed and cut on the outer surface of the second sleeve connection part, and a buckling component is installed in penetration within the two through-grooves thereby allowing to block at a ring-shaped groove of the admission connector for fixedly positioning, wherein a position-limiting ring groove enlarging a pipe diameter for positioning a leakage blocking ring is installed in a second recess on the first sleeve connection part of the admission pipe at the periphery of the admission hole toward the direction of the channel, wherein an accommodation groove having an enlarged diameter of hole for positioning an O-shaped ring is installed in a first recess on the second sleeve connection part of the admission pine at the periphery of the exit hole toward the direction of the channel, wherein an abutting face allowing the O-shaped ring to abut against the admission connector so as to exhibit an elastic transformation is formed on the bottom of the accommodation groove in the second sleeve connection part adjacent to the channel, wherein the admission pipe includes a stopping face formed on the inner wall of the two neighboring through-grooves, the two sides of a base part in the buckling component extend outwardly to form relative elastic parts and buckling parts, and the two elastic parts bend inwardly adjacent to the base part and form a clamping arm relatively and inwardly clamping on the stopping face, then the two elastic parts respectively bend outwardly and extend out to a stopping ring buckled into the ring-shaped groove of the admission connector.

2. The admission pipe structure for automobile air admission according to claim 1, wherein an exhaust recycle connector connected to the inside of the channel is installed on the outer surface of the pipe body of the admission pipe.

3. The admission pipe structure for automobile air admission according to claim 1, wherein an arch-shaped pull ring is formed at the center of the base part in the buckling component, and the ends of the two buckling parts are both formed with an outwardly bended abutting end.

4. The admission pipe structure for automobile air admission according to claim 1, wherein the admission pipe is made of aluminum alloy materials.

* * * * *